United States Patent [19]

Bigler

[11] 4,300,453

[45] Nov. 17, 1981

[54] SHAPED CHARGE WARHEAD

[75] Inventor: Hans-Ulrich Bigler, Opfikon, Switzerland

[73] Assignee: Werkzeugmaschinenfabrik Oerlikon-Bührle AG, Zurich, Switzerland

[21] Appl. No.: 103,695

[22] Filed: Dec. 14, 1979

[30] Foreign Application Priority Data

Dec. 20, 1978 [CH] Switzerland ..... 12916/78

[51] Int. Cl.[3] ..... F42B 1/00

[52] U.S. Cl. ..... 102/307; 102/309

[58] Field of Search ..... 102/24 HC, 56 SC, 307, 102/309

[56] References Cited

U.S. PATENT DOCUMENTS

| | | | |
|---|---|---|---|
| 2,419,414 | 4/1947 | Mohaupt | 102/56 SC |
| 2,672,094 | 3/1954 | Roberts | 102/241 |
| 2,766,507 | 10/1956 | Farber et al. | 102/56 SC |
| 3,021,784 | 2/1962 | Meddick | 102/24 HC |
| 3,371,605 | 3/1968 | Eckels | 102/24 HC |
| 3,855,933 | 12/1974 | Messineo | 102/476 |
| 3,976,010 | 8/1976 | Zernow | 102/24 X |
| 4,004,515 | 1/1977 | Mallory | 102/24 X |

FOREIGN PATENT DOCUMENTS

| | | | |
|---|---|---|---|
| 2239759 | 3/1972 | Fed. Rep. of Germany . | |
| 2553245 | 6/1977 | Fed. Rep. of Germany . | |
| 1199923 | 12/1959 | France . | |
| 1228247 | 8/1960 | France . | |
| 72904 | 9/1960 | France . | |
| 2003374 | 11/1969 | France . | |
| 2410243 | 11/1977 | France | 102/56 SC |
| 578775 | 8/1948 | United Kingdom . | |

OTHER PUBLICATIONS

"Explosiv Stoffe" Aug. 1959, article entitled The Shaped Charge, pp. 155–159.

*Primary Examiner*—Peter A. Nelson

*Attorney, Agent, or Firm*—Werner W. Kleeman

[57] ABSTRACT

A shaped charge warhead comprising a sleeve, which, in order to improve the rate of detonation of the shaped charge is more weakly structured at the region of a hollow space or cavity of the shaped charge, for instance by providing at such location internal threading, reduced wall thickness or using a weaker material, or combinations thereof.

1 Claim, 1 Drawing Figure

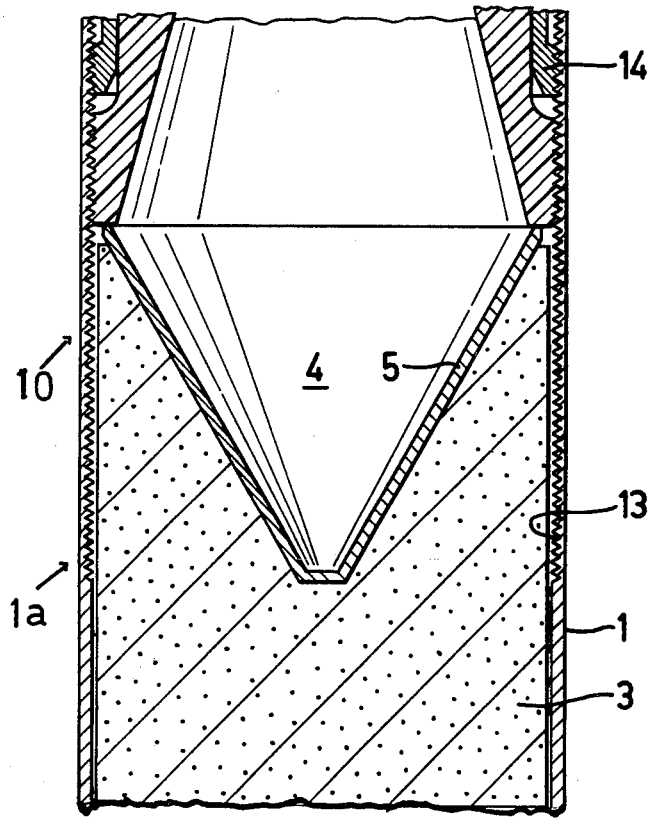
14
10
4
5
13
1a
1
3

SHAPED CHARGE WARHEAD

BACKGROUND OF THE INVENTION

The present invention relates to a new and improved construction of a shaped charge warhead which is of the type comprising a shaped charge arranged within a sleeve and having a hollow space or cavity.

A prior art shaped charge projectile of this type, as disclosed in German Pat. No. 1,478,008, teaches the provision of a projectile jacket or shell which is threadably connected at its rear end with a socket and has an outer circumferential groove, for instance for receiving a rotating or guide band. This projectile shell is relatively thin, but no specific measures are taken however in order to weaken the shell or jacket at the region of the hollow space.

SUMMARY OF THE INVENTION

Tests have shown that the rate of detonation of the shaped charge can be appreciably improved, if the sleeve is formed, for instance, of plastic instead of steel. What is meant under the expression improved rate of detonation is that, in the case of a shaped charge warhead, there is produced a more effective jet, producing a greater penetration of the projectile into the target.

Therefore, with the foregoing in mind, its is a primary object of the present invention to provide a new and improved construction of a shaped charge warhead which has a greater penetration depth at the target.

Another important object of the present invention aims at structuring a shaped charge warhead such that there is realized a more effective jet which, in turn, increases the target penetration depth of the warhead.

Now in order to implement these and still further objects of the invention, which will become more readily apparent as the description proceeds, the shaped charge warhead of the present development is manifested by the features that the sleeve is structured to be weaker at the region of the hollow space or cavity than externally of such region. This can be accomplished in a number of ways. Preferably, the sleeve is designed to have a thinner wall at the region of the hollow space than externally of such region. In particular, the sleeve can be provided with internal threading at the region of the hollow space. Moreover, at the region of the hollow space the sleeve can be formed of a weaker material than externally of such region. For instance, the material of the sleeve can be plastic or aluminum at the region of the hollow space and externally thereof can be steel.

BRIEF DESCRIPTION OF THE DRAWING

The invention will be better understood and objects other than those set forth above will become apparent when consideration is given to the following detailed description thereof. Such description makes reference to the annexed drawing wherein the single FIGURE shows in fragmentary sectional view an exemplary embodiment of shaped charge warhead.

DETAILED DESCRIPTION OF THE PREFERRED EMBODIMENTS

Referring now to the drawing, the single FIGURE shows in longitudinal sectional view part of a shaped charge warhead 10 constructed according to the invention. This shaped charge warhead 10—which also can be referred to as a conical shaped charge warhead—will be seen to comprise a sleeve 1 at the rear end of which there is secured a conventional detonator or fuze. Internally of the sleeve 1 there is arranged a hollow charge 3 having at its front end a substantially conical hollow space or cavity 4 which, in known manner, is provided with a suitable liner or lining 5.

The front end 1*a* of the sleeve 1, in other words, the region of the sleeve 1 located at the hollow space or cavity 4 is weaker than externally of such region. This can be accomplished, as mentioned, in a number of different ways. For instance, the front end 1*a* of the sleeve 1 can be provided with internal threading 13, serving for attachment of a standard and therefore not particularly further illustrated ogive 14. Through the provision of the internal threading 13 the region 1*a* of the sleeve 1 located at the hollow space 4 has a thinner wall. This internal threading 13 extends, as contemplated by the invention, over the entire region of the hollow space 4 of the shaped charge 3, i.e. from the base to the apex of the conical hollow space or cavity, as shown, so that the sleeve 1 is appreciably weakened at the region of the hollow space or cavity 4. It is however conceivable to weaken the sleeve 1 at the region 1*a* of the hollow space 4 by simply making it thinner walled. Another possibility is to form the region 1*a* of the sleeve 1 of a material which is weaker than the remainder of the material of the sleeve 1, for instance to form such region 1*a* of plastic or aluminium if the remaining portion of the sleeve 1 is formed of for instance steel. What is important is that the sleeve 1 is weaker at the region of the hollow space 4 than externally of such region, and the foregoing possibilities, including different combinations thereof as well as equivalent measures, can be used to obtain this result.

While there are shown and described present preferred embodiments of the invention, it is to be distinctly understood that the invention is not limited thereto, but may be otherwise variously embodied and practised within the scope of the following claims. Accordingly,

What I claim is:

1. A shaped warhead comprising:

a sleeve;

a hollow charge arranged within said sleeve;

said hollow charge containing a substantially conical hollow cavity having a base and an apex; and said sleeve being provided with internal threading extending from the base to the apex of said conical hollow cavity, so as to impart thereto a thinner and therefore weaker wall structure extending from said base to said apex of the conical hollow cavity.

* * * * *